US005687752A

United States Patent [19]

Boylan

[11] Patent Number: 5,687,752

[45] Date of Patent: Nov. 18, 1997

[54] DINING TABLE HAVING INTEGRAL DISHWASHER

[76] Inventor: Carroll J. Boylan, 3410 W. 88th, Leawood, Kans. 66206

[21] Appl. No.: 558,176

[22] Filed: Nov. 15, 1995

[51] Int. Cl.[6] ..... A47L 15/42

[52] U.S. Cl. ..... 134/115 R; 134/143; 134/165; 134/177; 134/200

[58] Field of Search ..... 134/115 R, 133, 134/135, 143, 144, 145, 148, 164, 165, 175, 176, 177, 179, 200, 201

[56] References Cited

U.S. PATENT DOCUMENTS

| | | | |
|---|---|---|---|
| 793,825 | 7/1905 | Curry et al. | 134/135 |
| 1,312,414 | 8/1919 | Monte | 134/177 X |
| 1,485,797 | 3/1924 | Merseles | 134/144 X |
| 1,603,259 | 10/1926 | Mathewson | 134/148 |
| 1,645,869 | 10/1927 | Murdoch | 134/143 |
| 2,646,056 | 7/1953 | Korns | 134/175 X |
| 2,750,611 | 6/1956 | Chatel . | |
| 2,782,426 | 2/1957 | Townsend . | |
| 2,886,837 | 5/1959 | Schara . | |
| 2,971,519 | 2/1961 | Wilson . | |
| 3,075,215 | 1/1963 | Marue . | |
| 3,207,167 | 9/1965 | Edstrom | 134/165 X |
| 3,605,769 | 9/1971 | Bagwell . | |
| 4,296,768 | 10/1981 | Saucedo . | |

FOREIGN PATENT DOCUMENTS

| | | | |
|---|---|---|---|
| 645941 | 9/1962 | Italy | 134/143 |

*Primary Examiner*—Philip R. Coe
*Attorney, Agent, or Firm*—Hovey, Williams, Timmons & Collins

[57] ABSTRACT

A space-saving dishwasher has a washing basin having side and bottom walls and an open top, and a vertically shiftable rack assembly for carrying dishes. A shifting mechanism is coupled with the rack assembly for selectively shifting the latter between a lower cleaning position, wherein the rack assembly is disposed within the basin below the open top, and an upper loading position, wherein the rack assembly is disposed above the open top of the basin. The dishwasher further includes a lid member for covering the open top of the basin when the rack assembly is in the cleaning position. Structure is also provided for cleaning the dishes carried in the rack assembly, when the assembly is in the cleaning position. The dishwasher is particularly designed for installment within an opening of a substantially horizontally extending table-top or kitchen counter top.

19 Claims, 2 Drawing Sheets

DINING TABLE HAVING INTEGRAL DISHWASHER

BACKGROUND OF THE INVENTION

1. Field of the Invention

The present invention relates generally to dishwashers and, more particularly, to a space-saving dishwasher, which may be installed within a counter top or table, having a dish-carrying rack that is vertically shiftable through the open top of the dishwasher for facilitating loading and unloading of the dishes.

2. Discussion of Prior Art

Conventional household dishwashers occupy a substantial amount of space in the kitchen. This problem is primarily attributable to the dishwasher's vertical, side opening and door swingable about a horizontal axis for covering the opening during washing operations. Although the dishwasher is normally installed under a kitchen counter, the swinging path of the door between its open and closed positions consumes a significant portion of the kitchen's floor space. Consequently, kitchens must be designed to accommodate the dishwasher along with the path of travel of its door.

The traditional dishwasher design presents additional problems. For example, in the open position, the door is lowered to extend generally horizontally from the opening of the dishwasher for providing a support surface on which the lower dish-carrying rack slides; that is to say, the lower rack is disposed very near the floor of the kitchen. This requires the user to repeatedly bend over as dishes and utensils are loaded or unloaded from the rack. Additionally, if the door is accidentally left in its open position, it poses a potential hazard to members of the household walking through the kitchen. Furthermore, the hinged connection of doors have been known to deteriorate due to wear and weight of the kitchen articles carried by the lower rack.

Dishwashers have been provided without the traditional swinging door. For example, dishwashers have been housed within dining room tables, with access to the washing chamber through the top of the table and dishwasher. Additionally, table-and-dishwasher combinations have been developed having a conveyor belt for conveying dirty dishes to a washing chamber within the table. Furthermore, combinations have been known to include a rotatable tray presenting a dining surface which is flipped over when the tray is rotated so that the tray and dishes/utensils secured thereto may be acted upon by a washing mechanism. Yet these designs are considerably complex, ineffective, weighty and space consuming. Thus, a need exists not only for a dishwasher that is space conscious and that eliminates the problems associated with conventional side opening dishwashers, but a dishwasher that is readily adaptable into a table or counter top because of its simple and relatively compact, yet effective construction.

OBJECTS AND SUMMARY OF THE INVENTION

Responsive to these problems, an object of the present invention is to provide a dishwasher that conserves space in the kitchen. Additionally, an object of the present invention is to provide a dishwasher that is durable yet compact, simple yet effective, and safe for household kitchens.

Another object of the present invention is to provide a dishwasher which may be placed within a table or kitchen counter, without needing the additional floor space required by conventional dishwasher doors. A yet further object of the present invention is to provide a "pop-up" dishwasher with an open top through which the dish-carrying racks may be shifted for loading and unloading thereof.

In accordance with these and other objects evident from the following description of a preferred embodiment of the invention, the dishwasher includes a washing basin having side and bottom walls and an open top, and a vertically shiftable rack assembly for carrying dishes. A shifting mechanism is coupled with the rack assembly for selectively shifting the rack assembly between a lower cleaning position, wherein the rack assembly is disposed within the basin below the open top, and an upper loading position, wherein the rack assembly is disposed above the open top of the basin. The dishwasher also includes a lid member for covering the open top of the basin when the rack assembly is in the cleaning position. The inventive dishwasher further includes structure for cleaning the dishes carried in the rack assembly when the assembly is in the cleaning position.

If desired, the lid member is coupled with the shifting mechanism for shifting movement with the rack assembly. Particularly, a bar suspends from the undersurface of the lid member to rotatably support the rack assembly, which is preferably constructed as a pair of vertically spaced wire frames. A number of internally threaded tubes are fixedly connected with the lid member, each tube receiving an upright externally threaded column, whereby rotation of the columns effects vertical shifting of the lid member and wire frames. The preferred lid member has a generally flat top surface which is coplanar with a table surface or counter top projecting generally horizontally from the basin.

Numerous advantages are realized with the construction of the present invention. For example, the user no longer has to bend over to load dishes into the dish-carrying racks of the dishwasher. Additionally, the dishwasher may be placed within a kitchen counter top or table. If the dishwasher has a dining surface projecting from the top of the basin (e.g., is placed within a table), household members simply place their dirty dishes in the raised rack assembly rather than having to perform the tedious task of carrying dishes to the sink. Moreover, the inventive dishwasher is space conscious, which is primarily attributable to the elimination of the side opening and corresponding swinging door.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figures 1, 2:
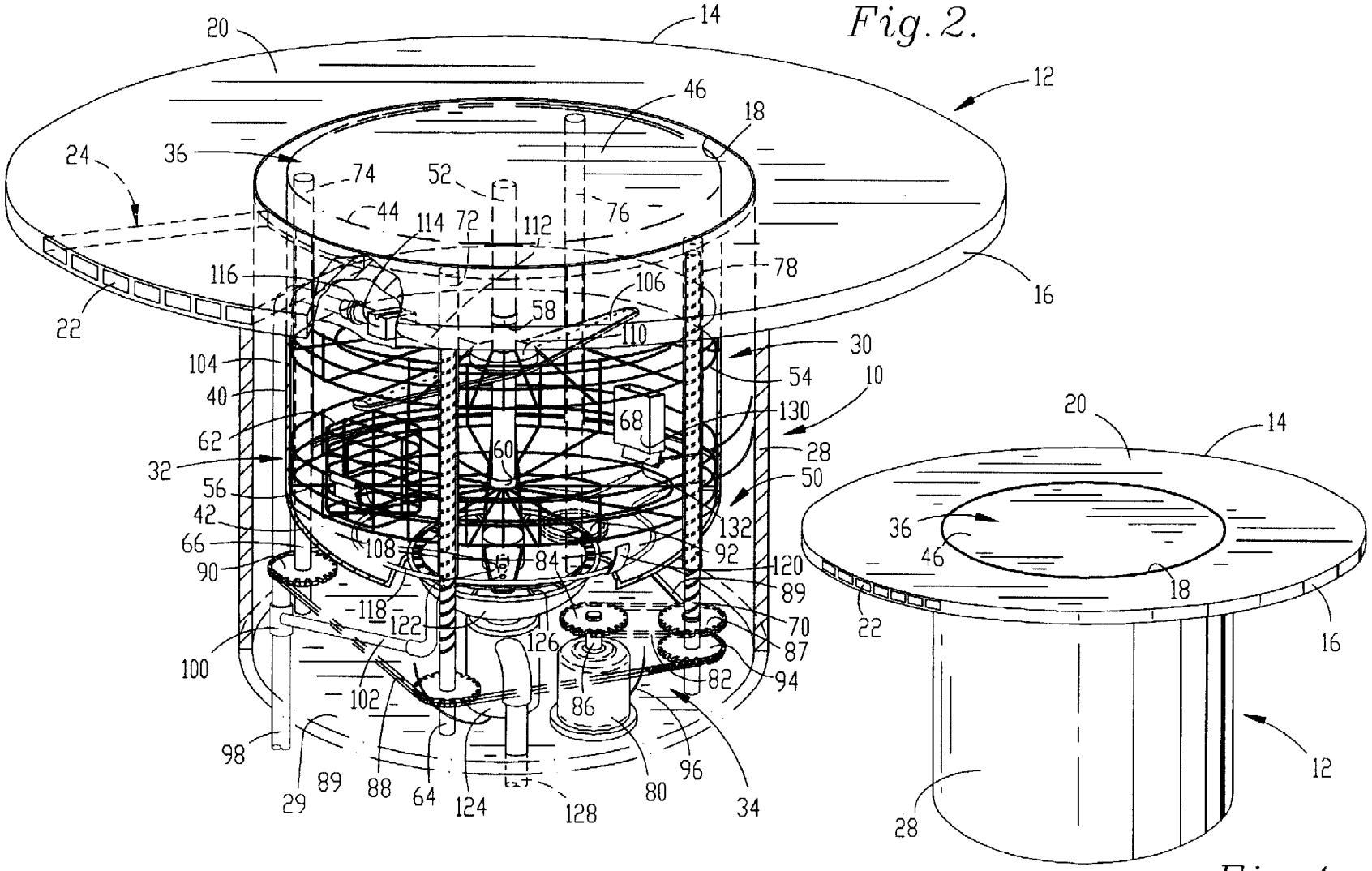
FIG. 1 is a perspective view of a table housing a dishwasher constructed in accordance with the preferred embodiment of the invention.
FIG. 2 is an enlarged perspective view of the dishwasher and table illustrated in FIG. 1, particularly illustrating the internal details of the dishwasher with the rack assembly in the lower, washing position.

Turning now to the drawings, and particularly FIG. 2, a dishwasher 10 constructed in accordance with the present invention is illustrated assembled to a table 12. The table 12 may assume a variety of shapes, but preferably includes a table-top 14 having a circular peripheral edge 16, a circular central opening 18 that is concentric with the edge 16, and a substantially horizontal dining surface 20 extending between the edge 16 and opening 18. For purposes which will subsequently be described, a series of control switches 22 are provided along the peripheral edge 16 of the table top. The switches 22 are coupled with the dishwasher 10 by wires extending through a cavity 24 formed in the table top 14. The table 12 further includes a cylindrical, hollow pedestal 28 for supporting the table top 14 and enclosing the dishwasher 10, although conventional table legs may be used. A floor member 29 is provided to close off the bottom of the pedestal 28. The pedestal 28 may be provided with a door for providing access to the dishwashers for maintenance and repair of the various components housed therein. It will be appreciated that the table-top 14 is attached to the pedestal 28 using wood screws or other conventional mechanical fasteners. Preferably, the table-top 14 and pedestal 28 are formed of wood, such as solid oak or particle board with a veneer coveting.

Figure 3:
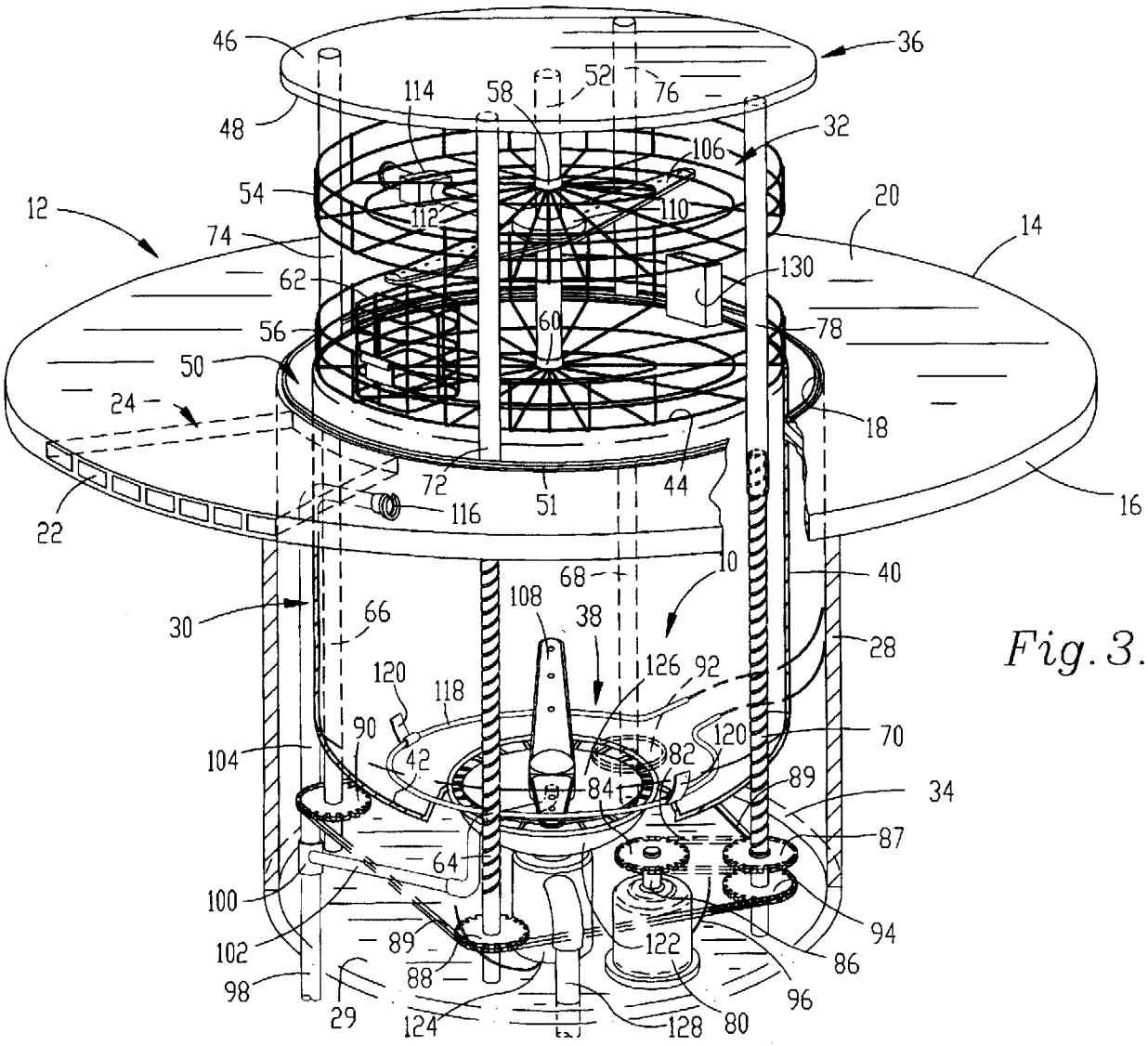
FIG. 3 is an enlarged perspective view similar to FIG. 2, but with the rack-assembly in the upper loading position.

Turning now to FIG. 3, the dishwasher 10 generally includes a washing basin 30, a vertically shiftable rack assembly 32 for carrying dishes, and a shifting mechanism 34 for selectively shifting the rack assembly 32 between a lower cleaning position, in which the rack assembly 32 is disposed within the basin 30, and an upper loading position, in which the rack assembly 32 is disposed above the basin 30. The dishwasher 10 further includes a lid member 36 for covering the basin 30 and structure for cleaning the dishes, generally denoted by the numeral 38, when the rack assembly is in the cleaning position.

In the illustrated embodiment, the washing basin 30 is concentrically received within the pedestal 28. Particularly, the basin 30 has a cylindrical shaped side wall 40 integrally formed with a concave bottom wall 42 and presenting an open top 44. The washing basin 30 may be formed of a high impact plastic, metal, or any other suitable material.

The lid member 36 is provided to cover the open top 44 of the basin 30 and takes the shape of a disc presenting a generally flat top surface 46 and undersurface 48. The preferred lid member 36 includes a top layer composed of the same material as the dining surface 20 attached by suitable means, such as mechanical fasteners, glue, etc., to a lower layer composed of the same material as the basin 30. A rubber seal ring is attached to the undersurface 48 of the lid member 36 in alignment with the top of the sidewall 40 of the basin 30 so that a sealing connection is formed between the lid member 36 and basin 30 when the lid member 36 is placed on top of the basin 30. Although the lid member 36 is provided primarily to seal the basin 30, the lid member 36 covers the entire opening 18 of the table-top 14, whereby the annular space 50 defined between the sidewall 40 and the pedestal 28 is also covered by the lid member 36. In this respect, when the lid member 36 is placed on top of the basin 30, a continuous, planar surface is defined by the top surface 46 of the lid member 36 and the dining surface 20 of the table-top 14. A rubber gasket 51 (FIG. 3) is attached to the table-top 14 along the opening 18 to accommodate the cover. Although the preferred lid member 36 is illustrated coupled to the shifting mechanism 34, it is entirely within the scope of the present invention to hingedly connect the lid member 36 to the basin 30 or table-top 14, or removably secure it to the basin 30. Finally, the lid member 36 includes a bar 52 suspending from the center of its undersurface 48, for purposes which will subsequently be described.

The preferred rack assembly 32 consists of an upper wire frame 54 and a lower wire frame 56, both of which are rotatably supported on the bar 52 by sealed beating assemblies, 58 and 60 respectively. Accordingly, the lid member 36 carries the wire frames 54,56 for shifting movement therewith, although it is within the ambit of the present invention to directly couple the rack assembly 32 with the shifting mechanism 34. The frames 54,56 have a generally circular shape which corresponds with the shape of the basin 30 and are formed of any suitable wire material, although a metal wire coated with a thermoplastic or resinous material is preferred. Additionally, the wire frames 54,56 may include structure for holding various dishes and utensils upright, such as the silverware rack 62 attached to the lower frame 56.

Preferably the shifting mechanism 34 includes four externally threaded, upright columns 64,66,68,70 which are rotatably supported on the floor member 29 by respective bearing assemblies. Four internally threaded tubes 72,74,76,78 are fixedly attached to the undersurface 48 of the lid member 36, each receiving a corresponding column, whereby rotation of the columns 64,66,68,70 effects axial movement of the tubes along the columns and in turn raises or lowers the lid member 36. As best shown in FIG. 3, the columns 64,66, 68,70 and tubes 72,74,76,78 are conveniently disposed within the space 50.

The shifting mechanism 34 further includes a reversible electric motor 80 secured to the floor panel 29 by conventional means. An endless chain 82 drivingly connects the column 70 to the motor 80 by entraining a sprocket 84 carried on the drive shaft 86 of the motor 80 and an upper sprocket 87 carried on the column 70. A relatively longer endless chain 89 entrains a lower sprocket 94 carried on the column 70 and the sprockets 88,90,92 carried on the respective columns 64,66,68 for transmitting rotation of the column 70 to the other columns 64,66,68. A three-position control switch 26 is coupled with the motor 80 via wire 96 to selectively supply power to the motor and reverse the direction of rotation of the drive shaft 86. It will be appreciated that when the motor 80 drives the shaft 86 in a clockwise direction where viewing the washer from above, the columns 64,66,68,70 are rotated clockwise which moves the tubes 72,74,76,78 upwardly along the columns and in turn raises the lid member 36 and rack assembly 32. Conversely, when the shaft 86 is driven in a counterclockwise direction, the columns 64,66,68,70 are rotated counterclockwise which moves the tubes 72,74,76,78 downwardly along the columns and in turn lowers the lid member 36 and rack assembly 32.

The present invention contemplates the use of structure for cleaning the dishes that is similar in principle to the construction of conventional dishwashers, such as those sold under the trademark "MAYTAG" or "KENMORE", although other cleaning structure may be used. Suffice it to explain that the preferred cleaning structure 38 includes an inlet pipe 98 connected with a source of hot water and a tee-connection 100 that diverts flow to a generally horizontally extending pipe 102 and upwardly extending pipe 104. The pipe 102 is connected with a lower rotatable spray washer 108 that sprays water and cleansing solution towards the dishes carried in the lower wire frame 56. In order to direct a spray of water and cleansing solution toward the dishes carried by the upper wire frame 54, an upper spray washer 106 is supported on the bar 52 for shifting movement with the rack assembly 32. A rotatable coupling 110 provides fluid connection between the spray washer 106 and a pipe extension 112 that is carried on the upper wire frame 54 by a support block 114. As best shown in FIG. 3, a flexible slip-boot 116 is attached to the end of the pipe 104 for releasably receiving the outer end of the pipe extension 112. Accordingly, the upper spray washer 106 is connected with the inlet pipe 98 when the rack assembly 32 is in its lower cleaning position, yet is disconnected from the inlet pipe 98 upon upward shifting of the rack assembly 32 towards its loading position.

The cleaning structure 38 also preferably includes a heating coil 118 secured to the sidewall 40 of the basin 30 by clips 120, wherein the heating coil 118 serves to dry the dishes carried by the rack assembly 32. The heating coil 118 may also serve to heat cleansing solution as it is recirculated through the spray washs 106,108 Furthermore, a funnel-shaped drain 122 is sealingly disposed within the central opening of the bottom wall 42 of the basin 30. The drain 122 is connected with a traditional garbage disposal 124, which serves to comminute food particles removed from the dishes. This is especially helpful in the illustrated embodiment because dishes will be placed directly in the dishwasher 10, without rinsing the food particles therefrom. To prevent ingress of utensils and other large articles unfit for comminution by the garbage disposal 124, the drain 122 is provided with a sieve 126. In the usual manner, the garbage disposal 124 connects with an outlet pipe 128. Although not illustrated or described in detail, the components of the dishwasher 10 are coupled with switches 22 for controlling operation of the dishwasher, as those of ordinary skill in the art will appreciate.

A typical cleaning cycle consists of initially rinsing the dishes so that food particles are dislodged therefrom. A conventional pump supplies high pressure hot water to the inlet pipe 98 whereby water is sprayed by the washers 106,108 toward the dishes. During the initial rinse, the garbage disposal 124 is operated to comminute the food particles as they drain from the basin 30. Furthermore, the inlet pipe 98 and the outlet pipe 128 are connected in a so-called "open circuit"; that is, the inlet pipe 98 is connected, via the pump, to the hot water heater tank of the home, while the outlet pipe 128 connects to the sewer line of the home. Before the initial rinse has completed, the outlet pipe 128 is blocked by suitable means, such as by a three-position control valve, so that the bottom of the basin 30 fills with water. Shortly thereafter, a soap container 130 connected to the lower wire frame 56 (FIG. 3) is energized in the usual manner, whereby its bottom panel 132 pivots downwardly to pour its contents into the basin. The soap container 130 is designed to hold a variety of different soap substances which are readily dissolvable in water to form a cleansing solution. Subsequently, the outlet pipe 128 is fluidly connected to the water supply pump (upstream from the inlet pipe 98) to form a "closed circuit", in which the pump serves to recirculate cleansing solution through the washing basin 30. During recirculation of the cleansing solution, the heating coil 118 may be activated to heat the water standing in the bottom of the basin 30. After the dishes have been thoroughly washed, the circuit is reopened such that the outlet pipe 128 fluidly connects to the sewer line and the cleansing solution drains from the basin 30. The dishes are rinsed in a manner similar to the initial rinse described above. Finally, the heating coil 118 is re-activated to dry the dishes.

Operation of the illustrated embodiment should be apparent from the foregoing. Nonetheless, it will be appreciated that the user manipulates the control switch 22 coupled with the shifting mechanism 34 to raise the lid member 36, and in turn shift the rack assembly 32 to the loading position (FIG. 3), so that dirty dishes may be loaded into the wire frames 54,56. After the dishes have been loaded, the control switch 22 is again manipulated to shift the rack assembly 32 to its lower cleaning position. Thereafter, in the traditional manner, the operator manipulates the various switches 22 coupled with the cleaning structure 38 to begin a washing cycle, as previously described. It will be appreciated that the dishwasher 10 includes a safety switch which automatically shuts down the cleaning structure 38 if the rack assembly 32 is accidently shifted during the washing cycle. Once the washing cycle is completed, the rack assembly 32 may be raised for unloading the clean dishes.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the dishwasher 10 may be installed in a kitchen counter top, rather than the table 12.

The inventor hereby states her intent to rely on the Doctrine of Equivalents to determine and assess the reasonably fair scope of the present invention as pertains to any apparatus not materially departing from but outside the literal scope of the invention as set out in the following claims.

What is claimed is:

1. A dishwasher comprising:

a washing basin having side and bottom walls and an open top;

a rack assembly for carrying dishes, and that is vertically shiftable between a lower cleaning position wherein the rack assembly is disposed within the basin below the open top and an upper loading position wherein the rack assembly is disposed above the open top of the basin;

a shifting mechanism coupled with the rack assembly for selectively shifting the assembly between the cleaning position and loading position;

a lid member for covering the open top of the basin when the rack assembly is in the cleaning position; and a cleaning means for cleaning the dishes carried in the rack assembly when the assembly is in the cleaning position, said lid member being coupled with the shifting mechanism for shifting movement with the rack assembly, said lid member having an undersurface and including a bar suspending from the undersurface to support the rack assembly, said rack assembly including a pair of vertically spaced wire frames, said frames being rotatably supported on the bar.

2. A dishwasher as claimed in claim 1, said cleaning means including upper and lower rotatable spray washers fluidly connected with a source of water.

3. A dishwasher as claimed in claim 2, said upper spray washer being attached to the bar between the wire frames for shifting movement therewith.

4. A dishwasher comprising:

a washing basin having side and bottom walls and an open top;

a rack assembly for carrying dishes, and that is vertically shiftable between a lower cleaning position wherein the rack assembly is disposed within the basin below the open top and an upper loading position wherein the rack assembly is disposed above the open top of the basin;

a shifting mechanism coupled with the rack assembly for selectively shifting the assembly between the cleaning position and loading position;

a lid member for covering the open top of the basin when the rack assembly is in the cleaning position; and a cleaning means for cleaning the dishes carried in the rack assembly when the assembly is in the cleaning position, said shifting mechanism including a number of upright, externally threaded columns received within corresponding internally threaded tubes, said tubes being coupled with the lid member whereby relative rotation between the tubes and the columns vertically shifts the lid member, said rack assembly being coupled with the lid member for shifting movement therewith.

5. A dishwasher as claimed in claim 4, said shifting mechanism further including drive means for selectively rotating the columns, said tubes being fixedly connected to the lid member so that rotation of the columns effects vertical shifting of the lid member and rack assembly.

6. In combination:

a table including a substantially horizontal surface having a central opening; and a dishwasher positioned within the opening, said dishwasher including a washing basin a having side and bottom walls and an open top, a rack assembly for carrying dishes, and that is vertically shiftable between a lower cleaning position wherein the rack assembly is disposed within the basin below the open top and an upper loading position wherein the rack assembly is disposed above the open top of the basin, a shifting mechanism coupled with the rack assembly for selectively shifting the assembly between the cleaning position and loading position, a lid member for covering the open top of the basin when the rack assembly is in the cleaning position, and a cleaning means for cleaning the dishes carried in the rack assembly when the assembly is in the cleaning position, said lid member being coupled with the shifting mechanism for shifting movement with the rack assembly, said lid member presenting an undersurface and a generally flat top surface which is coplanar with the dining surface when the rack assembly is in the cleaning position, said lid member including a bar suspending from the undersurface to support the rack assembly said rack assembly including a pair of vertically spaced wire frames, said frames being rotatably supported on the bar.

7. In a combination as claimed in claim 6, said shifting mechanism including a number of upright, externally threaded columns received within corresponding internally threaded tubes, said tubes being coupled with the lid member whereby relative rotation between the tubes and the columns vertically shifts the lid member and wire frames.

8. In a combination as claimed in claim 7, said shifting mechanism further including drive means for selectively rotating the columns, said tubes being fixedly connected to the undersurface of the lid member so that rotation of the columns effects vertical shifting of the lid member and wire frames.

9. A dishwasher comprising:

a washing basin having side and bottom walls and an open top;

a lid member vertically shiftable into and out of a covering relationship with the open top of the basin;

a shifting mechanism connected to the lid member for selectively shifting the lid member into and out of said covering relationship;

a rack assembly for carrying dishes, said rack assembly being carried by said lid member for vertical shifting between a lower cleaning position wherein the lid member is in said covering relationship and the rack assembly is disposed within the basin below the open top, and an upper loading position wherein the lid member is out of said covering relationship and the rack assembly is disposed above the open top of the basin; and a cleaning means for cleaning the dishes carried in the rack assembly when the assembly is in the cleaning position.

10. A dishwasher as claimed in claim 9, said lid member having an undersurface and including a bar suspending from the undersurface to support the rack assembly.

11. A dishwasher as claimed in claim 9, and a working surface projecting generally horizontally from the basin.

12. A dishwasher as claimed in claim 11, said working surface circumscribing the top of the basin, said lid member having a generally flat top surface which is coplanar with the working surface when the rack assembly is in the cleaning position.

13. In combination:

a table including a substantially horizontal dining surface having a central opening; and a dishwasher positioned within the opening, said dishwasher including a washing basin having side and bottom walls and an open top, a lid member vertically shiftable into and out of a covering relationship with the open top of the basin, a shifting mechanism connected to the lid member for selectively shifting the lid member into and out of said covering relationship, a rack assembly for carrying dishes, said rack assembly being carried by said lid member for vertical shifting between a lower cleaning position wherein the lid member is in said covering relationship and the rack assembly is disposed within the basin below the open top, and an upper loading position wherein the lid member is out of said covering relationship and the rack assembly is disposed above the open top of the basin, and a cleaning means for cleaning the dishes carried in the rack assembly when the assembly is in the cleaning position.

14. In a combination as claimed in claim 13, said dining surface being generally circular, said opening being generally circular and located concentrically within the dining surface.

15. In a combination as claimed in claim 14, said table further including a hollow pedestal connected with the dining surface for supporting the latter, the pedestal being configured for receiving the dishwasher therein.

16. In a combination as claimed in claim 15, said pedestal being generally cylindrical and connected to the dining surface along the opening thereof so that the pedestal is concentric with the dining surface and opening.

17. In a combination as claimed in claim 13, said lid member presenting an undersurface and a generally flat top surface which is coplanar with the dining surface when the rack assembly is in the cleaning position.

18. In a combination as claimed in claim 17, said lid member including a bar suspending from the undersurface to support the rack assembly.

19. In combination:

a table including a substantially horizontal dining surface having a central opening; and a dishwasher positioned within the opening, said dishwasher including a washing basin having side and bottom walls and an open top completely circumscribed by the dining surface, a rack assembly for carrying dishes, and that is vertically shiftable between a lower cleaning position wherein the rack assembly is disposed within the basin below the open top and an upper loading position wherein the rack assembly is disposed above the open top of the basin, a lid member intercoupled with the rack assembly for vertical shifting therewith such that the member is in a covering relationship with the open top of the basin when the rack assembly is in the cleaning position, said lid member having a top surface that is substantially flush with the dining surface when the member is in said covering relationship, and a shifting mechanism coupled with the rack assembly for selectively shifting the assembly between the cleaning position and loading position, a cleaning means for cleaning the dishes carried in the rack assembly when the assembly is in the cleaning position.

* * * * *